US007171828B2

(12) United States Patent
Kim et al.

(10) Patent No.: US 7,171,828 B2
(45) Date of Patent: Feb. 6, 2007

(54) WASHING MACHINE

(75) Inventors: Hyung-Kyoon Kim, Suwon (KR); Seung-Ho Lee, Anyang (KR); Sang-Yeon Pyo, Suwon (KR); Chan-Woo Park, Anyang (KR); Myung-Gyu Lee, Suwon (KR); Hyun-Sook Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 516 days.

(21) Appl. No.: 10/197,332

(22) Filed: Jul. 18, 2002

(65) Prior Publication Data

US 2003/0154749 A1 Aug. 21, 2003

(30) Foreign Application Priority Data

Feb. 15, 2002 (KR) ..... 2002-8245

(51) Int. Cl.
*D06F 17/05* (2006.01)

(52) U.S. Cl. ..... 68/133; 68/134

(58) Field of Classification Search ..... 68/133, 68/132, 134, 23 R

See application file for complete search history.

(56) References Cited

U.S. PATENT DOCUMENTS 1,741,191 A * 12/1929 Kirby ..... 68/133
2,145,453 A 1/1939 Miller
2,145,454 A 1/1939 Miller
2,509,264 A 5/1950 Cox
2,554,573 A * 5/1951 Johnson ..... 192/17 R (Continued)

FOREIGN PATENT DOCUMENTS

JP 6422286 * 1/1989

(Continued)

OTHER PUBLICATIONS

Europena Patent Office (EPO) 833 004 Apr. 1, 1998.*

(Continued)

*Primary Examiner*—Frankie L. Stinson
(74) *Attorney, Agent, or Firm*—Staas & Halsey LLP

(57) ABSTRACT

A washing machine includes a wobbling device having a rotary blade. The wobbling device causes a wobbling action of a washboard without rotating the washboard during a washing mode operation, and rotates the rotary blade in one direction to allow a sufficient amount of wash water to flow upward through an ascending water current guide and fall from an upper portion of a spin-drying tub onto clothes contained in the spin-drying tub, thus effectively washing the clothes. The washboard is installed at a lower portion in the spin-drying tub such that it wobbles upward and downward. The rotary blade is installed under the washboard, and is rotated in one direction by torque of a washing shaft. The rotary blade is fitted over a boss which couples a vertical rotary shaft of the wobbling device to the washing shaft, and is rotated by the torque of the washing shaft. The water current guide extends along a sidewall of the spin-drying tub from a lower end to an upper end of the spin-drying tub. Water currents generated from the rotary blade are guided to the upper portion of the spin-drying tub and fall from the upper portion to the lower portion of the spin-drying tub.

27 Claims, 9 Drawing Sheets

U.S. PATENT DOCUMENTS 2,645,111 A * 7/1953 Fields ..... 68/23.6
2,695,510 A 11/1954 Clark
2,715,826 A * 8/1955 Kirby ..... 68/23.6
2,831,333 A * 4/1958 Smith ..... 68/131
2,902,851 A * 9/1959 Fields ..... 68/131
2,902,852 A * 9/1959 Fields ..... 68/131
2,921,460 A * 1/1960 Aberle ..... 68/131
2,931,201 A 4/1960 Hubbard
2,948,128 A 8/1960 Smith
3,091,953 A * 6/1963 Hubbard ..... 68/12.21
3,102,408 A * 9/1963 Pelensky ..... 68/18 FA
3,102,410 A * 9/1963 Doyle ..... 68/23.5
3,290,908 A * 12/1966 McAllister et al. ..... 68/17 A
3,412,621 A 11/1968 Jacobs
4,112,518 A * 9/1978 Garlinghouse ..... 366/219
4,321,809 A 3/1982 Bochan
4,428,088 A 1/1984 Getz et al.
4,489,574 A 12/1984 Spendel
4,779,430 A 10/1988 Thuruta et al.
4,862,710 A 9/1989 Torita et al.
5,000,015 A 3/1991 Nakamura et al.
5,144,819 A 9/1992 Hiyama et al.
5,297,307 A 3/1994 Baek
5,353,612 A * 10/1994 Noguchi et al. ..... 68/12.02
5,460,018 A 10/1995 Werner et al.
5,504,955 A 4/1996 Mueller et al.
5,507,053 A 4/1996 Mueller et al.
5,737,790 A 4/1998 Badger et al.
5,743,115 A 4/1998 Hashimoto
5,768,728 A 6/1998 Harwood et al.
5,791,167 A * 8/1998 Wyatt et al. ..... 68/134
5,829,276 A * 11/1998 Suh et al. ..... 68/53
5,943,885 A 8/1999 Park
5,946,949 A 9/1999 Park et al.
6,070,439 A * 6/2000 Jung ..... 68/53
6,115,863 A * 9/2000 Mason et al. ..... 8/159
6,227,013 B1 * 5/2001 Wyatt-Smith ..... 68/134
6,460,381 B1 10/2002 Yoshida et al.
6,557,382 B1 5/2003 Koike et al.
2003/0110816 A1 * 6/2003 Chang ..... 68/53

FOREIGN PATENT DOCUMENTS

JP 7-31786 2/1995

OTHER PUBLICATIONS

U.S. Appl. No. 10/197,336, filed Jul. 18, 2002, Hyung-Kyoon Kim et al., Samsung Electronics Co., Ltd.
U.S. Appl. No. 10/216,238, filed Aug. 12, 2002, Sang-Yeon Pyo et al., Samsung Electronics, Co., Ltd.
U.S. Appl. No. 10/216,430, filed Aug. 12, 2002, Hyun-Sook Kim et al., Samsung Electronics Co., Ltd.

* cited by examiner

WASHING MACHINE

CROSS-REFERENCE TO RELATED APPLICATIONS

This application claims the benefit of Korean Patent Application No. 2002-8245 filed on Feb. 15, 2002, in the Korean Industrial Property Office, the disclosure of which is incorporated herein by reference.

BACKGROUND OF THE INVENTION

1. Field of the Invention

The present invention relates, to washing machines and, more particularly, to a washing machine having a wobbling device which causes a wobbling action of a washboard and a rotary blade which selectively rotates to guide wash water to an upper portion of a spin-drying tub of the washing machine, so as to effectively wash clothes.

2. Description of the Related Art

Generally, washing machines are used to wash clothes by rotating a cylindrical rotary tub containing the clothes and wash water therein. Such washing machines have been typically classified into two types, that is, drum type washing machines and vertical shaft type washing machines. In the drum type washing machines, a rotary tub is horizontally set in a cabinet and is rotated around a horizontal axis of the cabinet in opposite directions. These actions repeatedly move the clothes seated on an internal lower surface of the rotary tub upward and allow the clothes to be dropped from the top to the bottom inside of the rotary tub, due to gravity, to wash the clothes. The vertical shaft type washing machines are designed such that a rotary tub with a pulsator is vertically set in a cabinet and is rotated around a vertical axis of the cabinet in opposite directions. The forced water currents generated by the pulsator wash the clothes inside the rotary tub of the vertical shaft type washing machines.

The present invention relates to vertical shaft washing machines. FIG. 1 shows the construction of a conventional vertical shaft type washing machine. The conventional vertical shaft type washing machine comprises a cabinet 1 which forms the external appearance of the washing machine. A tub assembly, consisting of two tubs, is set in the cabinet 1. That is, a washing tub 2 is vertically set in the cabinet 1 and contains wash water therein, while a spin-drying tub 3 is rotatably and concentrically set in the washing tub 2. The spin-drying tub 3 is perforated in its sidewall to have spin-drying perforations 3*c*. A pulsator 4 is installed on the bottom of the spin-drying tub 3, and generates wash water currents inside the spin drying tub 3. The vertical shaft type washing machine also has a drive motor 5 and a power transmission unit 6 which are installed in a space between the bottom of the washing tub 2 and the bottom of the cabinet 1. The drive motor 5 is a reversible motor, which generates a reversible rotating force. The power transmission unit 6 transmits the reversible rotating force from the drive motor 5 to the tub assembly, thus rotating the spin-drying tub 3 and the pulsator 4.

The top of the cabinet 1 is open to allow a user to place or remove the clothes from the spin-drying tub 3. A door 7 is hinged to an edge of the open top of the cabinet 1. The user is thus allowed to open the top of the cabinet 1 to place or remove the clothes from the spin-drying tub 3. A drain hose 8 extends from the bottom of the washing tub 2 to the outside of the cabinet 1, and discharges the wash water from the washing tub 2 to the outside after a washing mode operation.

The spin-drying tub 3 comprises a bottom part 3*a*, with a spin-drying shaft holder 9 exteriorly mounted to the bottom part 3*a*. The power transmission unit 6 has two shafts 6*a* and 6*b*. That is, the spin-drying shaft 6*a* of the power transmission unit 6 is coupled to the bottom of the spin-drying tub 3 by the shaft holder 9, while the washing shaft 6*b* of the power transmission unit 6 passes through the interior of the spin-drying shaft 6*a* so as to be coupled to the pulsator 4. The pulsator 4 is installed on the interior-bottom of the spin-drying tub 3. The washing shaft 6*b* rotates the pulsator 4 during the washing mode operation.

An ascending water current guide ("water current guide") 10 is provided in a sidewall of the spin-drying tub 3. The water current guide 10 guides wash water currents, which are generated by a reversible rotating action of the pulsator 4 during a washing mode operation, to an upper portion of the spin-drying tub 3 and discharges the wash water from the upper portion onto the clothes contained in the spin-drying tub 3. Accordingly, detergent in the wash water is more effectively dissolved and hydraulic and mechanical impact energies are applied to the clothes to improve the washing effect of the washing machine. A lint trap 11 is provided at the top of the water current guide 10 and collects impurities, such as lint, from the wash water discharged from the water current guide 10.

The above vertical shaft type washing machine with the pulsator 4 is operated as follows. When the washing machine is turned on after placing clothes into the spin-drying tub 3, water is primarily fed into the washing tub 2. The reversible drive motor 5 is rotated to generate a rotating force, which is transmitted to the pulsator 4 through the washing shaft 6*b* of the power transmission unit 6. Accordingly, the pulsator 4 is rotated in opposite directions. Such a reversible rotating action of the pulsator 4 generates forced wash water currents inside the spin-drying tub 3, and the clothes are washed by being forcibly moved along with the forced wash water currents while coming into frictional contact with both an internal surface of the spin-drying tub 3 and with each other.

Some of the wash water currents generated by the pulsator 4 are introduced into the water current guide 10, and ascend through the water current guide 10 to reach the upper portion of the water current guide 10 prior to being discharged from the water current guide 10 onto the clothes contained in the spin-drying tub 3. The washing effect of the washing machine is thus improved. When the wash water is discharged from the water current guide 10, a variety of impurities, such as lint, in the wash water are captured and collected in the lint trap 11.

When such a washing mode operation is completed, after elapse of a predetermined period of time, the wash water is drained from the washing tub 2 to the outside of the washing machine through the drain hose 8 before a rinsing mode operation is started. After the rinsing mode operation, a high speed rotating force of the reversible drive motor 5 is transmitted to the spin-drying tub 3 through the spin-drying shaft 6*a* of the power transmission unit 6, thus rotating the spin-drying tub 3 in a direction at a high speed to spin-dry the clothes. When a spin-drying mode operation is completed, the washing machine finishes the operation of washing the clothes.

In the washing mode operation of the conventional vertical shaft type washing machine, the pulsator 4 is alternately rotated in opposite directions to generate the forced wash water currents in the spin-drying tub 3, to wash the clothes. Thus, the clothes are forcibly moved in the opposite directions, and are twisted and tangled up to each other. Therefore, the conventional vertical shaft type washing machine abrades and damages the clothes during the washing operation, and forces a user to untwist and untangle the clothes after the washing operation. Accordingly, such a vertical shaft type washing machine is inconvenient to use and promotes rapid wear and tear of the clothes.

In addition, to generate the forced wash water currents, the pulsator 4 must be reversibly rotated in short time intervals during the washing mode operation. Thus, the reversible drive motor 5 consumes a lot electric power while being repeatedly rotated back and forth in the opposite directions at such short time intervals. Such an alternating rotation of the reversible drive motor 5 also reduces the expected life span of the reversible drive motor 5.

Also, during the washing operation, only a small portion of the forced water currents generated by the pulsator 4 is introduced into the ascending water current guide 10, moved upward through the water current guide 10 to reach the upper portion of the spin-drying tub 3, and discharged onto the clothes because the pulsation 4 is reversibly rotated in short intervals. Thus, it is almost impossible to form a sufficient amount of ascending water currents. Furthermore, such ascending water currents are only intermittently generated by the reversible rotating action of the pulsator 4. Therefore, the washing effect caused by the ascending water currents is not sufficiently provided.

Furthermore, the conventional vertical shaft type washing machine with the pulsator 4 is designed such that a desired washing effect is enhanced by forcibly rotating the clothes in the opposite directions using the forced water currents. Accordingly, such a design requires an excessive amount of water in the washing tub 2 during the washing mode operation. A large volume of the water required for the washing operation, in turn, requires an additional use of detergent, inevitably causing a greater harm to the environment. Recent trends show that consumers are making a conscious decision to save water and restrict the use of household chemicals to preserve the environment. Therefore there is a need to solve the above-mentioned problems experienced by the conventional vertical shaft type washing machines.

SUMMARY OF THE INVENTION

Accordingly, it is an object of the present invention is to provide a washing machine having a wobbling device which causes an upward and downward wobbling action of a washboard without rotating the washboard during a washing mode operation, and a rotary blade which is selectively rotated to allow a sufficient amount of wash water to flow upward through an ascending water current guide to fall from an upper portion of a spin-drying tub onto clothes contained therein, thus effectively washing the clothes.

Additional objects and advantages of the invention will be set forth in part in the description which follows and, in part, will be obvious from the description, or may be learned by practice of the invention.

To accomplish the above and other objects of the present invention, there is provided a washing machine comprising a washing tub for containing wash water therein, a spin-drying tub rotatably set in the washing tub for containing clothes therein, a spin-drying shaft which rotates the spin-drying tub, a washing shaft which axially passes through and projects from a top end of the spin-drying shaft, and a wobbling device which is coupled to a projected end of the washing shaft and causes the clothes to wobble upward and downward to wash the clothes, wherein the wobbling device comprises a washboard which is arranged at an interior lower portion of the spin-drying tub, and wobbles upward and downward, and a rotary blade which is provided under the washboard, and rotates in one direction by torque of the washing shaft to guide the wash water to an upper portion of the spin-drying tub.

The wobbling device further comprises an inclined rotary shaft which is arranged in an axial direction of the washing shaft at an angle of inclination, a first rotary unit which rotates in response to the torque of the washing shaft, having a first sloping surface which is inclined in a radial direction of the washing shaft at a set angle of inclination, a second rotary unit which is arranged to be rotated relative to the first rotary unit, having a second sloping surface which corresponds to the first sloping surface of the first rotary unit, and a hole which is axially formed in the second rotary unit and rotatably receives the inclined rotary shaft therein, an actuating pin installed to and rotates along with one of the washing shaft, the first rotary unit and the inclined rotary shaft, and a wobbling pin and a leveling pin which are provided on the second rotary unit at spaced positions, wherein the washboard is arranged outside the second rotary unit, and wobbles upward and downward in response to rotating of the actuating pin in contact with the wobbling pin, and is leveled in response to rotating of the actuating pin in contact with the leveling pin.

A vertical rotary shaft is arranged between the washing shaft and the first rotary unit, and transmits the torque of the washing shaft to the first rotary unit. A boss is arranged between the vertical rotary shaft and the washing shaft, and couples the vertical rotary shaft to the washing shaft so as to transfer the torque of the washing shaft to the vertical rotary shaft.

A plurality of spline ridges may be formed around an external surface of the boss, and a plurality of spline grooves may be formed around an internal surface of a central hole of the rotary blade, wherein the spline ridges engage with the spline grooves to allow the rotary blade to be rotated by torque of the boss, which is rotated in response to rotating of the washing shaft.

The rotary blade comprises a circular base panel part, and a plurality of vanes which are regularly arranged on a lower surface of the circular base panel part and extend in radial directions to generate wash water currents.

An ascending water current guide is provided in a sidewall of the spin-drying tub which extends from a lower end to an upper end of the spin-drying tub in a vertical direction. The rotary blade is arranged at a lower end of the ascending water current guide, wherein the water currents from the vanes are guided into the ascending water current guide and flow upward therein to fall from an upper end of the ascending water current guide to a lower portion of the spin-drying tub.

BRIEF DESCRIPTION OF THE DRAWINGS

These and other objects and advantages of the present invention will become apparent and more readily appreciated from the following description of the embodiments, taken in conjunction with the accompanying drawings of which:

FIGS. 2A and 2B are sectional views showing the construction of a vertical shaft type washing machine having a wobbling device according to an embodiment of the present invention, in which FIG. 2A shows the washing machine with the wobbling device placed in its leveling position for performing a spin-drying mode operation, and FIG. 2B shows the washing machine with the wobbling device placed in its wobbling position for performing a washing mode operation;

FIGS. 3A and 3B are exploded perspective views showing the construction of the wobbling device shown in FIGS. 2A and 2B, in which FIG. 3A shows the construction of an upper portion of the wobbling device, and FIG. 3B shows the construction of a lower portion of the wobbling device;

DETAILED DESCRIPTION OF THE PREFERRED EMBODIMENTS

Figure 1:
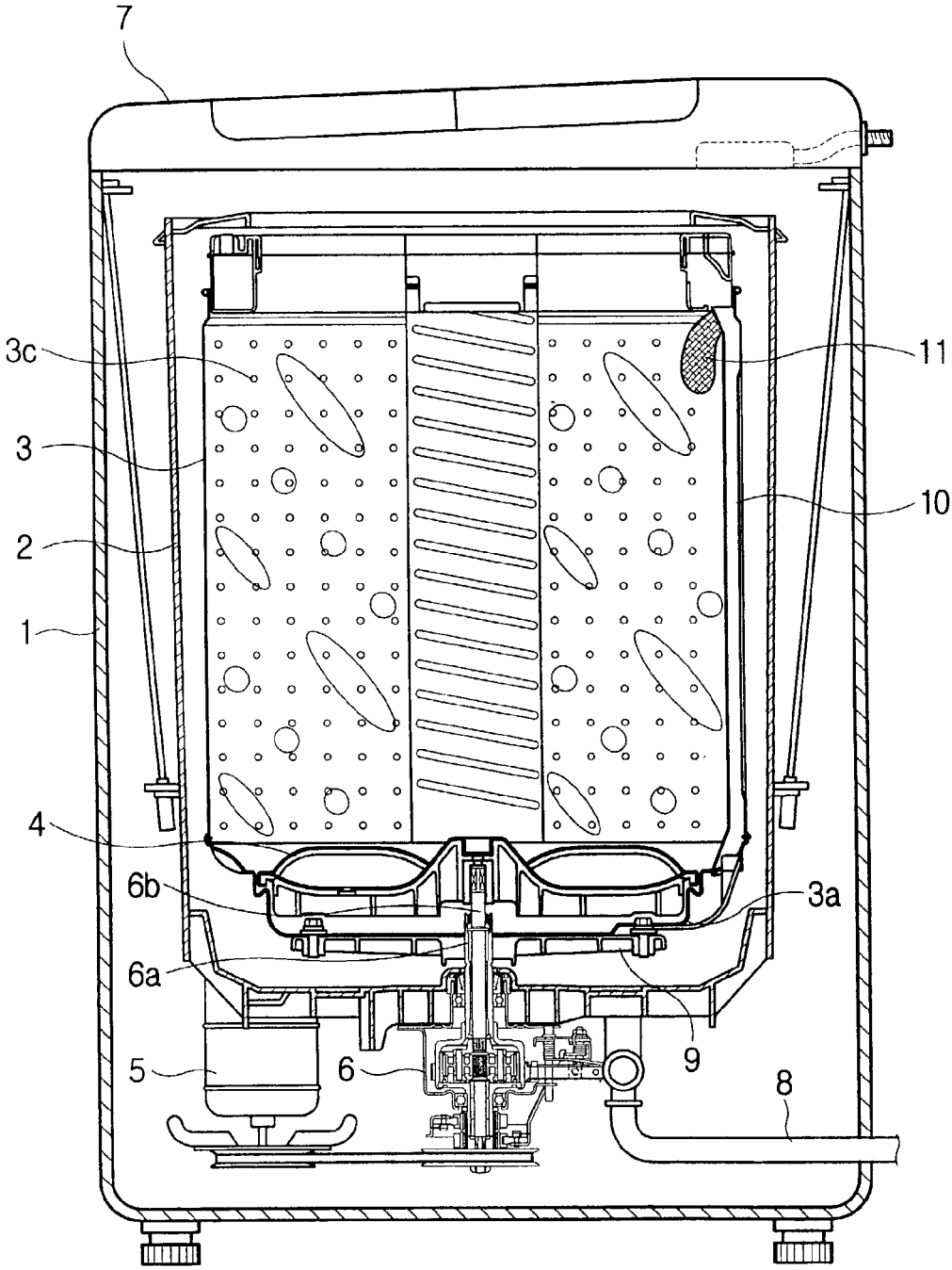
FIG. 1 (PRIOR ART)
FIG. 1 is a sectional view showing the construction of a conventional vertical shaft type washing machine having a pulsator.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2A:
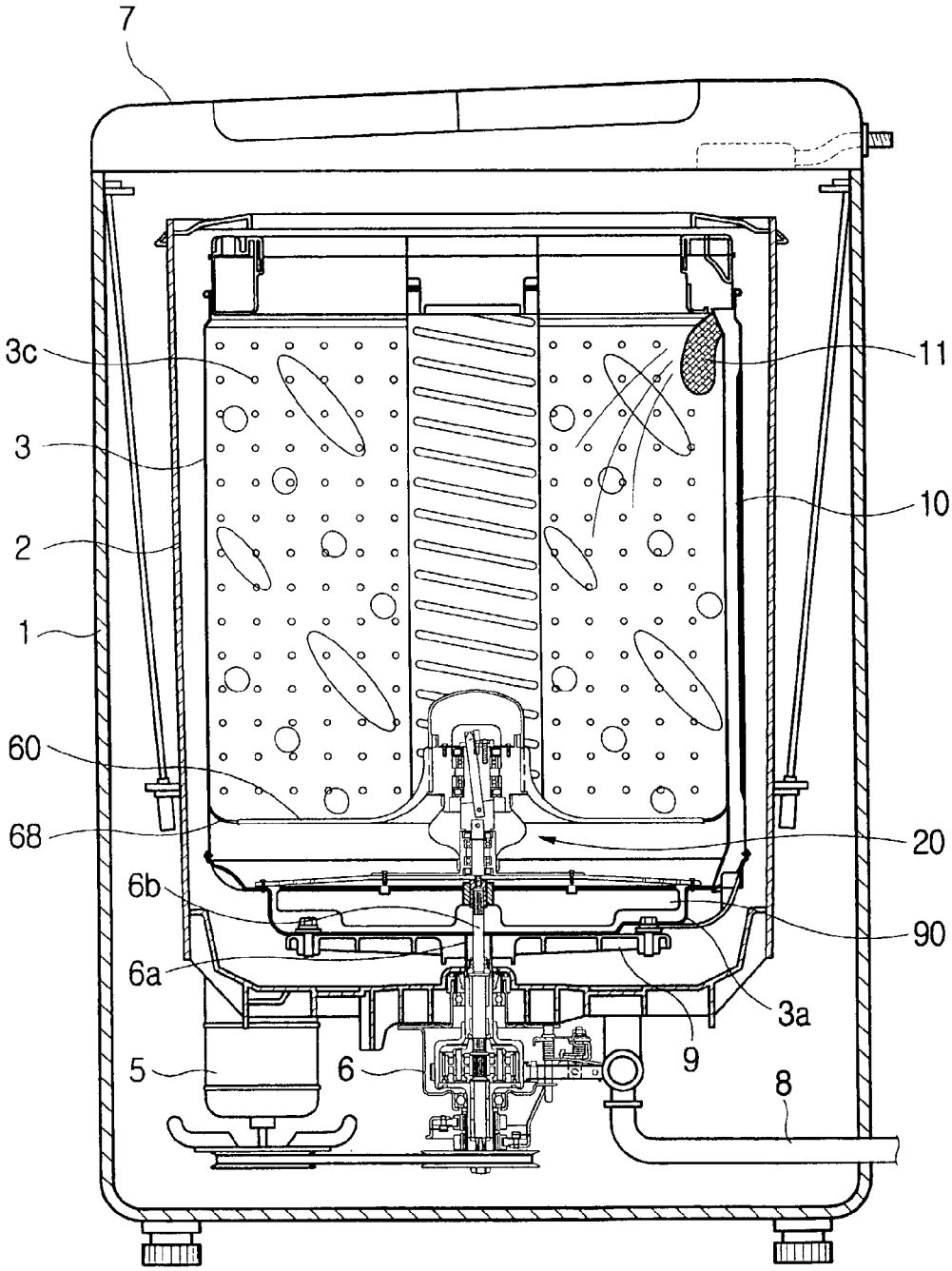
Figure 2B:
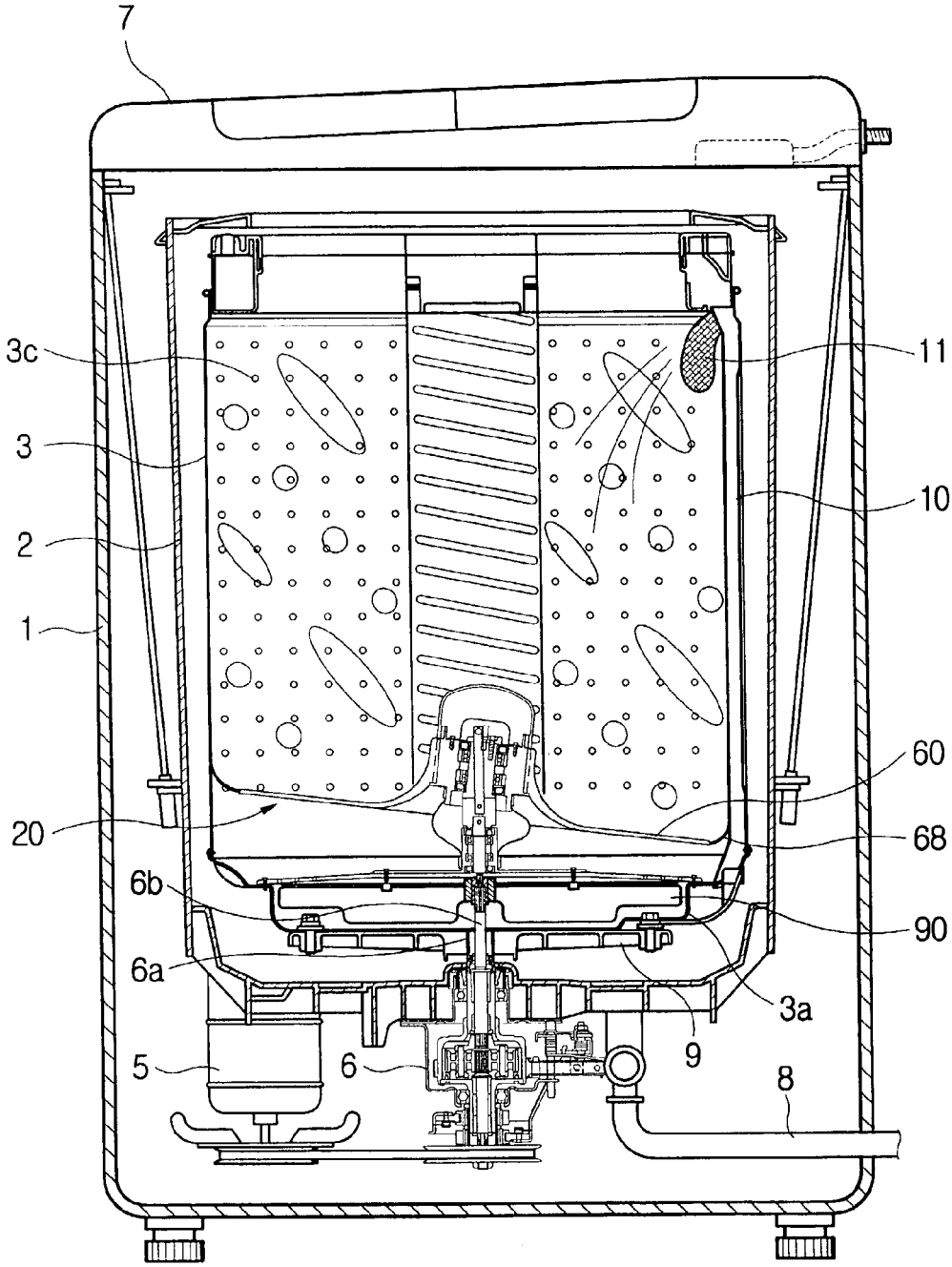

FIGS. 2A and 2B show the construction of a vertical shaft type washing machine having a wobbling device according to an embodiment of the present invention. Specifically, FIG. 2A shows the wobbling device placed in its leveling position for performing a spin-drying mode operation, while FIG. 2B shows the wobbling device placed in its wobbling position for performing a washing mode operation. The technical term "wobbling position" means a position where the wobbling device arranges a washboard in an inclined position so as to cause an upward and downward wobbling action of the washboard. The technical term "leveling position" means a position where the wobbling device arranges the washboard in a horizontal position so as to hold the washboard without allowing such a wobbling action of the washboard.

As shown in FIGS. 2A and 2B, the vertical shaft type washing machine ("washing machine") of the present invention comprises a tub assembly having two tubs set in a cabinet 1. That is, a washing tub 2 is vertically set in the cabinet 1 for containing wash water therein, while a spin-drying tub 3 is rotatably and concentrically set in the washing tub 2. The spin-drying tub 3 is perforated on its sidewall to have a plurality of spin-drying perforations 3*c*. In addition, both a drive motor 5 and a power transmission unit 6 are installed in a space between the bottom of the washing tub 2 and the bottom of the cabinet 1. The washing machine further comprises a wobbling device 20 installed on the bottom of the spin-drying tub 3.

A spin-drying shaft holder 9 is mounted to an exterior portion of bottom part 3*a* of the spin-drying tub 3. The bottom part 3*a* couples a spin-drying shaft 6*a* of the power transmission unit 6 to the spin-drying tub 3. The spin-drying shaft 6*a* rotates the spin-drying tub 3 during a spin-drying mode operation. A washing shaft 6*b* of the power transmission unit 6 passes through the interior of the spin-drying shaft 6*a*, and is projected upward from a top end of the spin-drying shaft 6*a* so as to be coupled to the wobbling device 20.

An ascending water current guide ("water current guide") 10 is vertically provided in a sidewall of the spin-drying tub 3 so as to extend from a lower portion to an upper portion of the spin-drying tub 3. A lint trap 11 is provided at a top end of the water current guide 10, and collects impurities, such as lint, from the wash water discharged from the water current guide 10. It is understood that the lint trap 11 may not be provided in the washing machine.

The wobbling device 20 is provided inside the cabinet 1 at the bottom of the spin-drying tub 3. During a washing mode operation of the washing machine, the wobbling device 20 is selectively placed at the wobbling position as shown in FIG. 2B, so as to arrange a washboard 60 to be in an inclined position and cause upward and downward wobbling action of the washboard 60. In such a case, a rotary blade 90 installed under the washboard 60 is rotated in one direction, and generates forced water currents. The forced water currents generated by the rotary blade 90 are guided to the upper portion of the spin-drying tub 3 through the water current guide 10 so as to fall from the upper portion of the water current guide 10 onto clothes contained in the spin-drying tub 3, thus enhancing the washing effect of the clothes. During a spin-drying mode operation of the washing machine, the wobbling device 20 is placed at the leveling position as shown in FIG. 2A, so as to arrange the washboard 60 in a horizontal position and allow the washboard 60 to be rotated along with the spin-drying tub 3 to spin-dry the clothes.

Figure 3A:
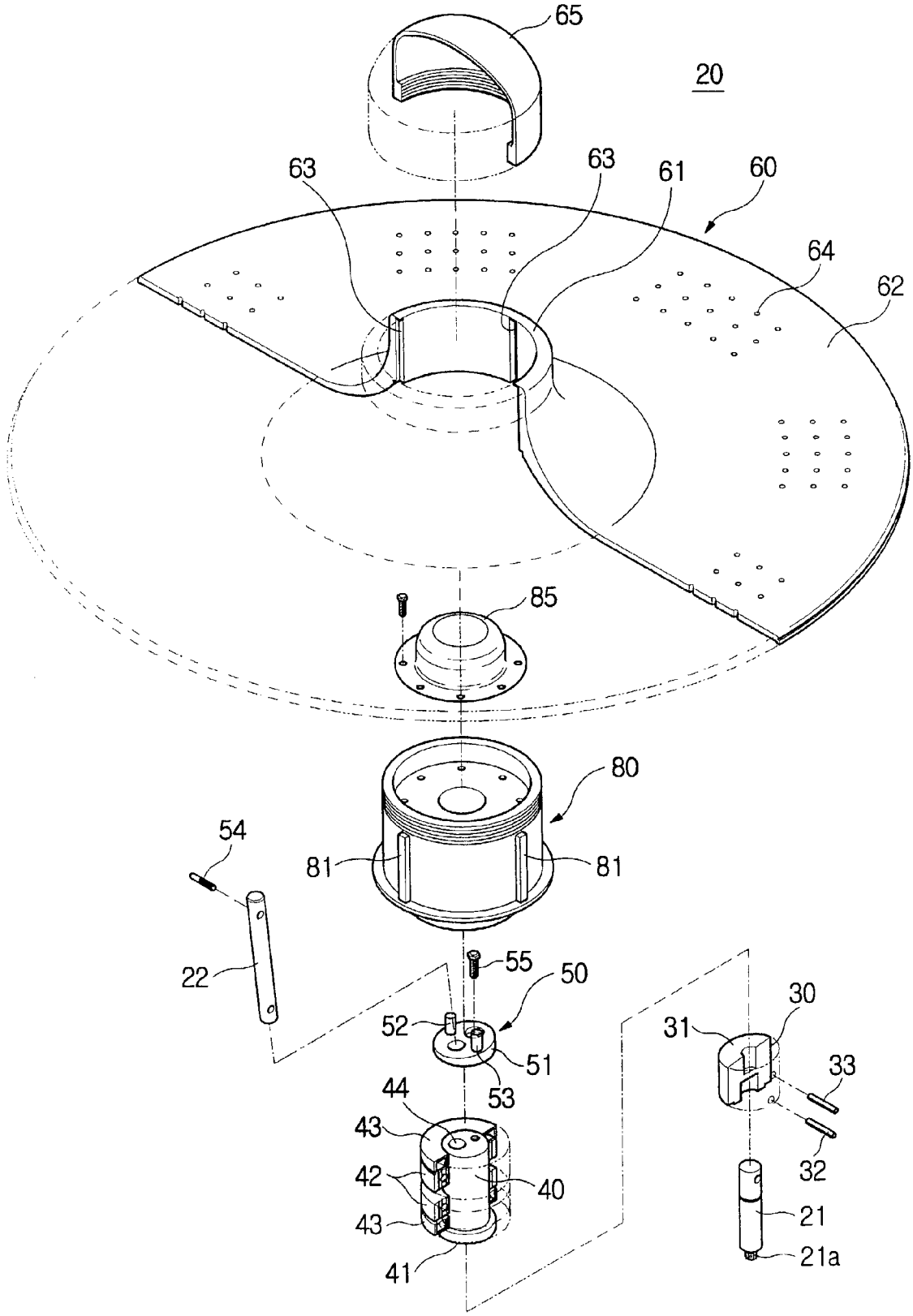
Figure 3B:
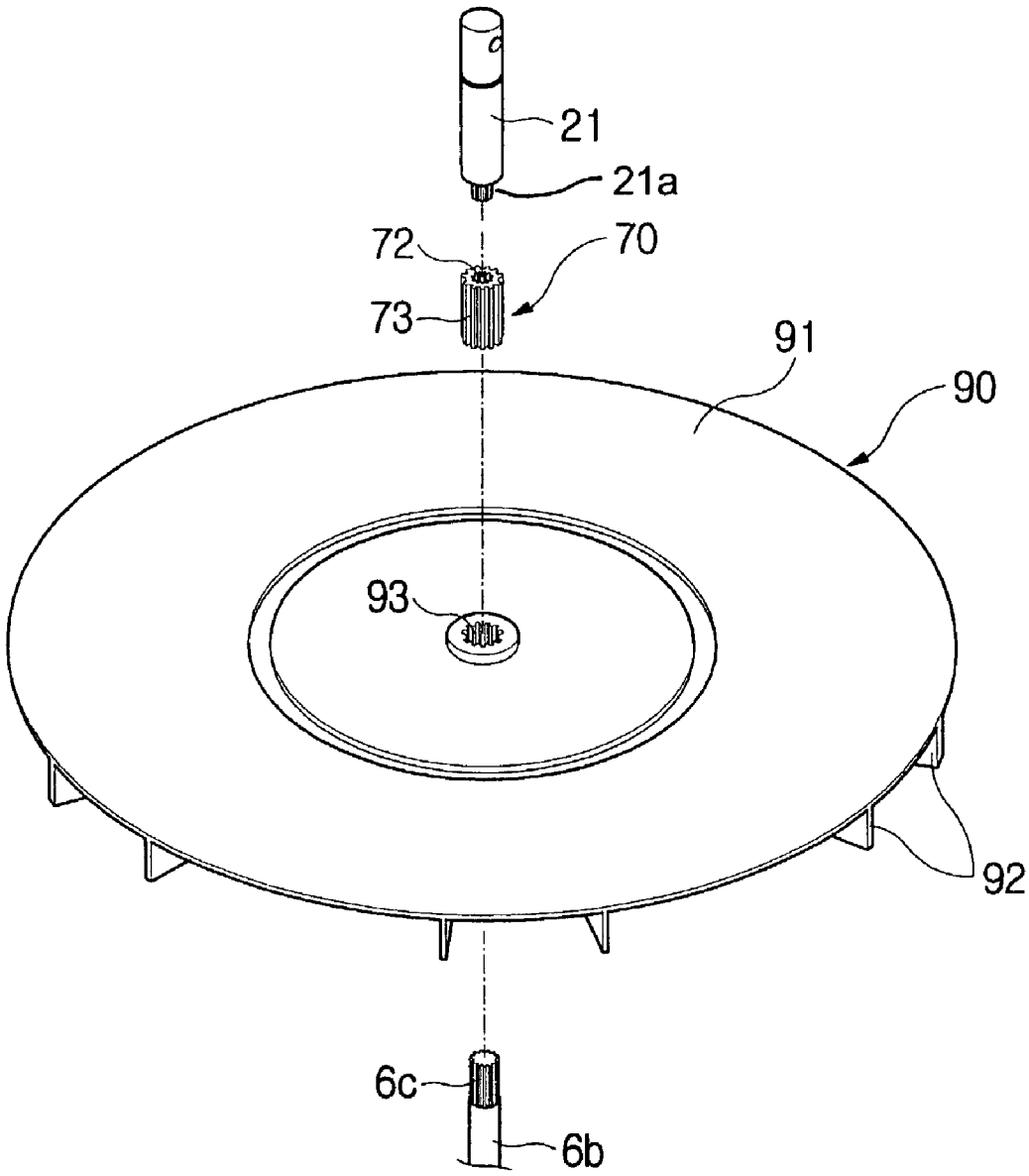

FIGS. 3A and 3B show exploded perspective views of the wobbling device 20 shown in FIGS. 2A and 2B. Specifically, FIG. 3A shows the construction of an upper portion of the wobbling device 20 above the rotary blade 90, while FIG. 3B shows a locking structure of the wobbling device 20 which locks the rotary blade 90 to the wobbling device 20.

As shown in FIG. 3A, the wobbling device 20 comprises a vertical rotary shaft 21, which is coupled to the washing shaft 6*b* of the power transmission unit 6. An inclined rotary shaft 22 is arranged above the vertical rotary shaft 21 while being inclined relative to a vertical axis at a predetermined angle of inclination. The wobbling device 20 further comprises a first rotary unit 30 which is used to rotate the vertical and inclined rotary shafts 21 and 22 at the same time. A second rotary unit 40 rotatably receives the inclined rotary shaft 22, and is laid at its lower surface on an upper surface of the first rotary unit 30. An actuating unit 50 is arranged on an upper surface of the second rotary unit 40, and selectively shifts the wobbling device 20 between the wobbling position and the leveling position. The washboard 60 is included in the wobbling device 20. The washboard 60 is shifted between two positions, that is, the inclined position and the horizontal position, according to the change in position of the wobbling device 20 between the wobbling position and the leveling position.

The vertical rotary shaft 21 is coupled at its top end to a lower portion of the first rotary unit 30 by a first locking pin 32, which transversely passes through both the first rotary unit 30 and the vertical rotary shaft 21. The vertical shaft 21 is rotatably supported by both a base 23 and a housing 24, which are installed at the bottom part 3*a* of the spin-drying tub 3 of FIG. 2A. The construction of the base 23 and the housing 24 is not shown in FIGS. 3A and 3B, but will be described in more detail later herein with reference to FIG. 4.

An upper surface of the first rotary unit 30 forms a first sloping surface 31, which is inclined in a radial direction of the washing shaft 6*b* at an angle of inclination. A lower surface of the second rotary unit 40, laid on the upper surface of the first rotary unit 30, forms a second sloping surface 41, which is inclined in the radial direction of the washing shaft 6*b* at the same inclination angle as that of the first sloping surface 31. The angle of inclination of the two sloping surfaces 31 and 41 determines an upward and downward wobbling angle of the washboard 60. The inclination angle of the two sloping surfaces 31 and 41 are set to, for example, about 5°~10°.

The positional change of the wobbling device 20 between the wobbling position, which causes an inclined position of the washboard 60 to perform a washing mode operation as shown in FIG. 2B, and the leveling position, which causes a horizontal position of the washboard 60 to perform a spin-drying mode operation as shown in FIG. 2B, is accomplished by varying an angular position of the second sloping surface 41 of the second rotary unit 40 relative to the first sloping surface 31 of the first rotary unit 30. Such a positional change of the wobbling device 20 will be described in more detail later herein.

Figure 4:
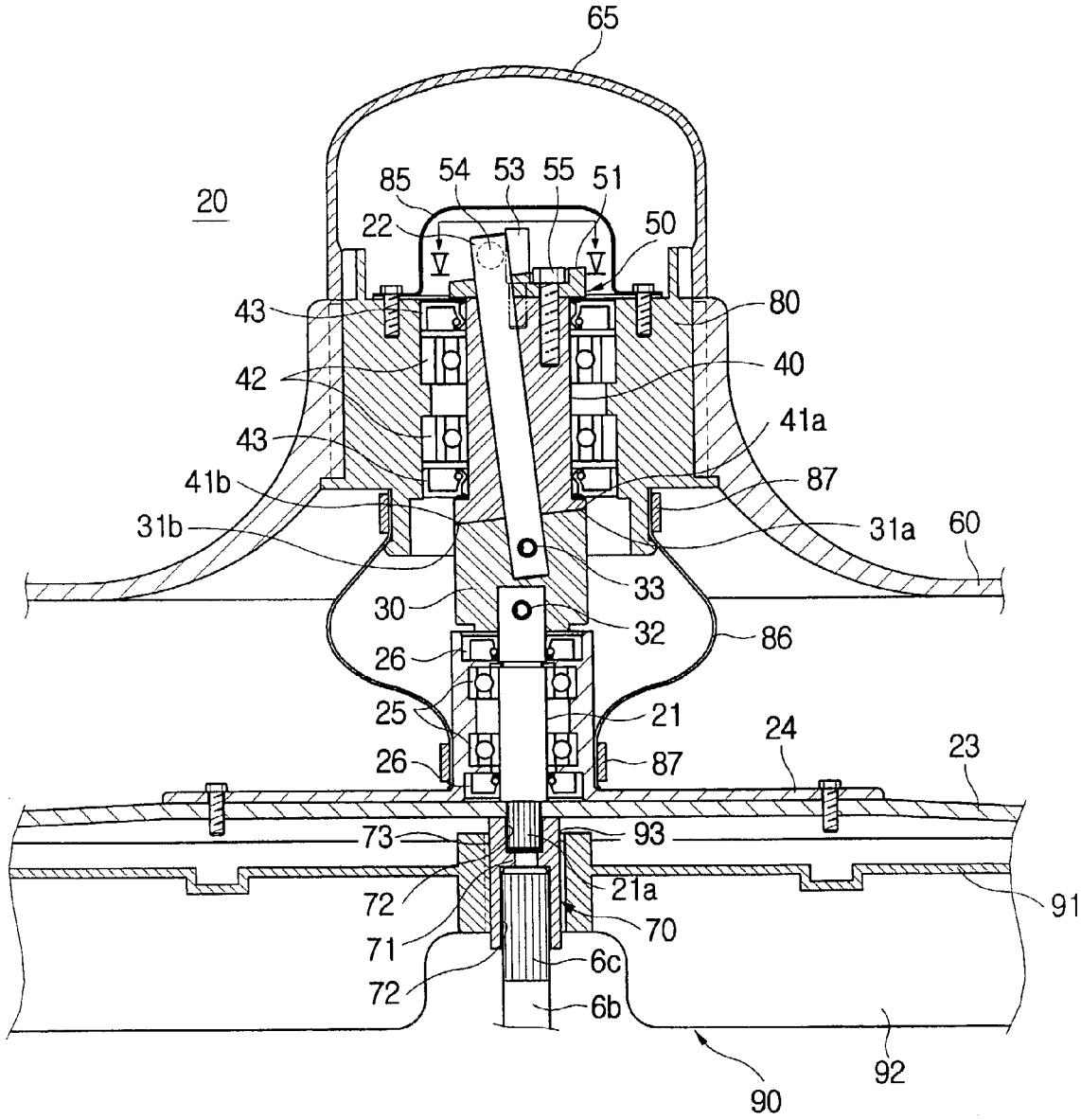
FIG. 4 is a sectional view of the wobbling device shown in FIGS. 2A and 2B in its leveling position.

The inclined rotary shaft 22 is rotatably received by the second rotary unit 40 while being inclined relative to the vertical rotary shaft 21*a* at, for example, the same inclination angle as that of the first and second sloping surfaces 31 and 41, as best seen in FIG. 4. The inclined rotary shaft 22 is coupled at its lower end to an upper portion of the first rotary unit 30 by a second locking pin 33, which transversely passes through both the first rotary unit 30 and the inclined rotary shaft 22. The inclined rotary shaft 22 is thus rotated along with the first rotary unit 30. That is, the first rotary unit 30 is coupled to both the vertical rotary shaft 21 at its lower end and the inclined rotary shaft 22 at its upper end. Both the first rotary unit 30 and the inclined rotary shaft 22 are thus rotated at the same time when the vertical shaft 21 is rotated.

In such a case, the inclined rotary shaft 22 passes through an inclined hole 44 of the second rotary unit 40 prior to being coupled at its lower end to the first rotary unit 30. The inclined rotary shaft 22 and the inclined hole 44 of the second rotary unit 40 are designed so as to form a small gap between the inclined rotary shaft 22 and the inclined hole 44 to allow the inclined rotary shaft 22 to rotate in the second rotary unit 40.

A support unit 80 is fitted over the second rotary unit 40, rotatably supports the rotary unit 40, and supports the washboard 60 so as allow the washboard 60 to wobble upward and downward without being rotated during the washing mode operation. To rotatably support the second rotary unit 40 relative to the support unit 80, a first bearing 42 is interposed between the second rotary unit 40 and the support unit 80. Two oil seals 43 are respectively provided at upper and lower ends of the first bearing 42 in order to seal the first bearing 42.

The upper surface of the second rotary unit 40 is a horizontal surface, as compared to its inclined lower surface 41. The actuating unit 50 is arranged on a horizontal upper surface of the second rotary unit 40.

The actuating unit 50 comprises an actuating plate 51, which is fastened to the upper surface of the second rotary unit 40 by a locking bolt 55. Two spaced pins, that is, a leveling pin 52 and a wobbling pin 53, extend upward from an upper surface of the actuating unit 50 at spaced positions to a predetermined height. An actuating pin 54 is transversely mounted to an upper portion of the inclined rotary shaft 22 so as to be selectively stopped by either of the two pins 52 and 53 according to a rotating direction of the inclined rotary shaft 22, thus rotating the second rotary unit 40 in a desired direction. The construction and operation of the actuating unit 50 will be described in more detail later herein.

The above actuating unit 50 is covered with a cap 85 so as to be isolated from the outside of the cap 85. This cap 85 is fastened to an upper end of the support unit 80.

The washboard 60 comprises a central boss part 61, which is formed at a central portion of the washboard 60. The central boss part 61 has a cylindrical shape and is fitted over an external surface of the support unit 80. A circular blade part 62 is integrally formed around an outside edge of the central boss part 61, and seats clothes thereon during the washing operation. The circular blade part 62 initially extends downward and outward from the outside edge of the boss part 61 to form a diffuser shape, and secondarily extends horizontally to form a horizontal circular shape. Perforations 64 are formed at the blade part 62 which allow an upward and downward circulation of wash water through the washboard 60.

As shown in FIGS. 2A and 2B, a covering plate 68 is arranged along the circular edge of the circular blade part 62 of the washboard 60 and covers a gap between the spin-drying tub 3 and an edge of the circular blade part 62. The covering plate 68 is made of a material which is more flexible than the material of the washboard 60. The covering plate 68 is arranged such that a gap is less likely to be left between the covering plate 68 and the spin-drying tub 3.

To fasten the washboard 60 to the support unit 80, a plurality of vertical ribs 81 are regularly formed on the external surface of the support unit 80. A plurality of vertical grooves 63 are regularly formed on an internal surface of the central boss part 61 of the washboard 60, and engage with the vertical ribs 81 of the support unit 80, respectively.

A covering cap 65 covers the upper end of the support unit 80 at the top of the central boss part 61 of the washboard 60, thus isolating the support unit 80 from the clothes seated on the washboard 60 during the washing operation. The covering cap 65 is fastened to the support unit 80 through a screw type engagement.

As shown in FIG. 3B, the vertical rotary shaft 21, coupled at its upper end to the lower portion of the first rotary unit 30, is coupled at its lower end to an upper end of the washing shaft 6*b* of the power transmission unit 6 through a tubular boss 70. The vertical rotary shaft 21 is thus rotated along with the first rotary unit 30 where the washing shaft 6*b* is rotated.

To couple the vertical rotary shaft 21 to the washing shaft 6*b* so as to transmit torque of the washing shaft 6*b* to the vertical rotary shaft 21 without failure, both the lower end of the vertical rotary shaft 21 and the upper end of the washing shaft 6*b* are machined at their external surfaces to have uniformly spaced spline ridges 21*a* and 6*c*, respectively. The tubular boss 70 is machined at its internal surface to have corresponding spline grooves 72. Therefore, the splined lower end of the vertical rotary shaft 21 is fitted into and coupled to the splined upper end of the tubular boss 70. In the same manner, the splined upper end of the washing shaft 6*b* is fitted into and coupled to the splined lower end of the tubular boss 70. As shown in FIG. 4, a step 71 is formed at an intermediate portion of the internal surface of the tubular boss 70 so as to separate the two shafts 6*b* and 21 from each other. Regularly formed around the external surface of the tubular boss 70 are several spline ridges 73, which engage with corresponding spline grooves 93 formed around an internal surface of a central hole of the rotary blade 90 to fit the rotary blade 90 over the tubular boss 70.

The rotary blade 90 comprises a circular base panel part ("panel part") 91 having a plurality of vanes 92 regularly and vertically arranged on a lower surface of the panel part 91. The above vanes 92 extend from a central area of the rotary blade 90 to an edge of the panel part 91 in radial directions.

To couple the rotary blade 90 to the tubular boss 70 so as to transmit torque of the tubular boss 70 to the rotary blade 90 without failure, the central boss of the rotary blade 90 includes the spline grooves 93 which engage with the spline ridges 73 of the tubular boss 70. Due to the engagement of the spline grooves 93 of the rotary blade 90 with the spline ridges 73 of the tubular boss 70, it is possible for the rotary blade 90 to be rotated by the torque of the washing shaft 6*b* without failure.

The engagement of the spline grooves 93 of the rotary blade 90 with the spline ridges 73 of the tubular boss 70 is accomplished through a forced fitting method, thus firmly locking the rotary blade 90 to the tubular boss 70.

In the above, the rotary blade 90 is fitted over and coupled to the tubular boss 70 through a spline coupling method. However, it is understood that the same operational effect may be accomplished by forcibly fitting a metal boss 70 into a center of a plastic rotary blade 90.

Figure 5:
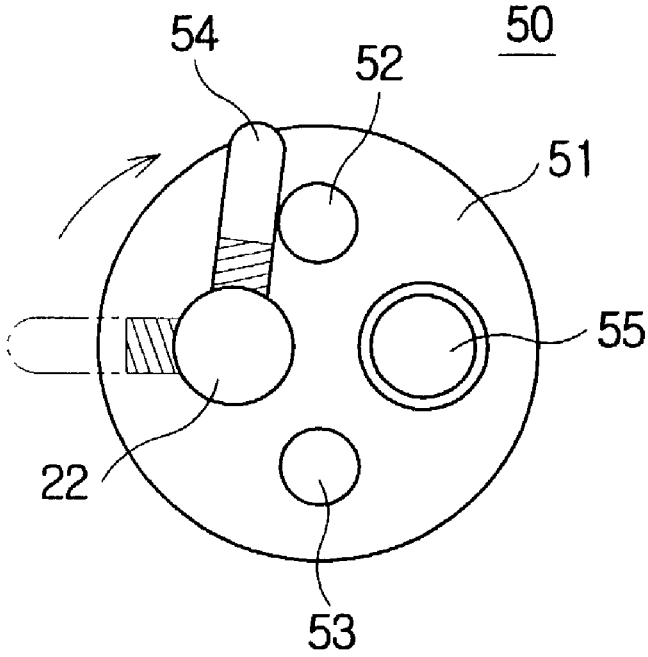
FIG. 5 is a sectional view of the wobbling device taken along the line V—V of FIG. 4.

FIG. 4 shows a sectional view of the wobbling device 20 placed in a leveling position. FIG. 5 shows a sectional view taken along the line V—V of FIG. 4 illustrating an operation of the actuating unit 50 where the wobbling device 20 is placed in the leveling position.

As shown in FIGS. 4 and 5, the vertical rotary shaft 21 is rotatably held by a second bearing 25 inside the housing 24. Two oil seals 26 are respectively provided at upper and lower ends of the second bearing 25 which seal the second bearing 25 and prevent an undesired infiltration of external impurities into the second bearing 25. The above housing 24 is bolted to an upper surface of the base 23. The base 23, having a disc shape with several holes, is also bolted to an internal surface of the bottom part 3*a* of the spin-drying tub 3 as shown in FIGS. 2A and 2B. The lower end of the vertical rotary shaft 21 and the upper end of the washing shaft 6*b* are coupled to the tubular boss 70 through a spline coupling method, and the vertical rotary shaft 21 is rotated by the torque of the washing shaft 6*b*.

In addition, the rotary blade 90 is assembled to the external surface of the tubular boss 70 through a spline locking method or a forced fitting method, and the rotary blade 90 is rotated by the torque of the washing shaft 6*b*.

The inclined rotary shaft 22 passes through the inclined hole 44 of the second rotary unit 40 at a predetermined angle of inclination, so as to have the upper and lower ends of the shaft 22 project from both ends of the second rotary unit 40. In such a case, a small gap is formed between the inclined rotary shaft 22 and the hole 44 of the second rotary unit 40 so as to allow the shaft 22 to be rotated relative to the second rotary unit 40.

The upper end of the vertical rotary shaft 21 and the lower end of the inclined rotary shaft 22 are coupled to the first rotary unit 30 by means of the two locking pins 32 and 33, respectively. Therefore, the two shafts 21 and 22 are rotated along with the first rotary unit 30.

The second rotary unit 40 is rotatably held in the support unit 80 by the first bearing 42 having the oil seals 43. The washboard 60 is assembled to the external surface of the support unit 80.

The actuating plate 51 of the actuating unit 50 is fastened to the upper surface of the second rotary unit 40 by the locking bolt 55. The two spaced pins, that is, the leveling pin 52 and the wobbling pin 53, extend upward from the upper surface of the actuating unit 50 at two positions, which are angularly spaced apart from each other by an angle of, for example, about 180° as shown in FIG. 5. The actuating pin 54 is transversely mounted to the upper portion of the inclined rotary shaft 22. The actuating pin 54 of the shaft 22 is selectively stopped by either of the two pins 52 and 53 in accordance with a rotating direction of the inclined rotary shaft 22, thus rotating the second rotary unit 40 assembled with the actuating plate 51.

Where the actuating pin 54 of the inclined rotary shaft 22 is rotated from a position shown by the two-dot chain line of FIG. 5 to another position shown by the solid line in accordance with a clockwise rotating action of the inclined rotary shaft 22, the actuating pin 54 is brought into contact with the leveling pin 52. In such a case, an upper part 31*a* of the first sloping surface 31 of the first rotary unit 30 meets an upper part 41*a* of the second sloping surface 41 of the second rotary unit 40 as shown in FIG. 4. In addition, a lower part 31*b* of the first sloping surface 31 of the first rotary unit 30 meets a lower part 41*b* of the second sloping surface 41 of the second rotary unit 40. Therefore, the upper surfaces of both the second rotary unit 40 and the support unit 80 are horizontally positioned. This creates a horizontal positioning of the washboard 60, which is assembled with the support unit 80. That is, the wobbling device 20 of this invention is placed in its leveling position for performing a spin-drying mode operation.

The second rotary unit 40 is rotatably set in the support unit 80 by means of the bearing 42. Thus, it is necessary to stably hold the support unit 80 such that the support unit 80 is not rotated regardless of a rotating action of the second rotary unit 40. To accomplish the above and other objects, a flexible holder 86 is installed at a position between the housing 24 and the support unit 80 while surrounding the first rotary unit 30 and a central portion of the housing 24. This flexible holder 86 is designed so as to be flexible in a vertical direction in response to a wobbling action of the washboard 60. Upper and lower ends of the flexible holder 86 are fastened to the support unit 80 and the housing 24 by means of, for example, fastening wires, 87 respectively.

Figure 6:
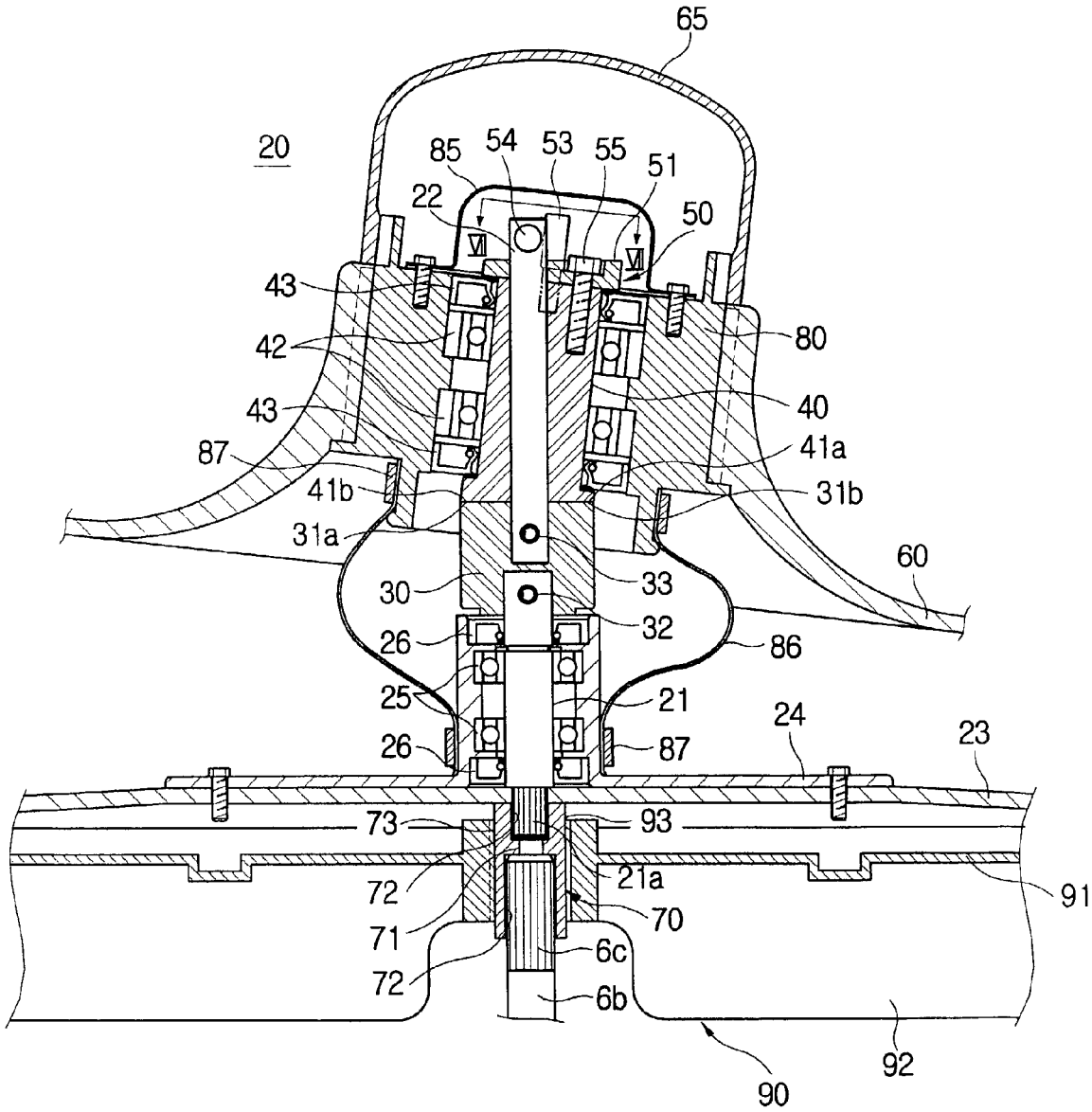
FIG. 6 is a sectional view of the wobbling device shown in FIGS. 2A and 2B in its wobbling position.
Figure 7:
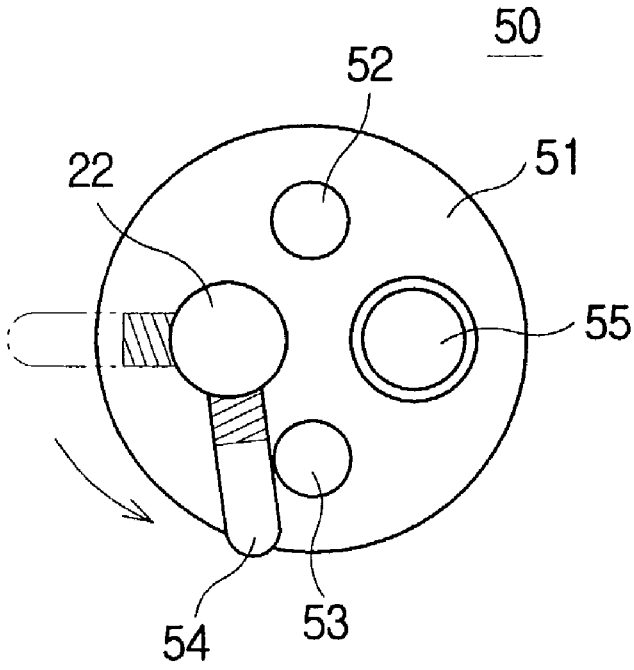
FIG. 7 is a sectional view of the wobbling device taken along the line VII—VII of FIG. 6.

FIGS. 6 and 7 show sectional views corresponding to FIGS. 4 and 5, respectively, where the wobbling device 20 is placed in the wobbling position as the washboard 60 wobbles upward and downward to perform a washing mode operation, and the rotary blade 60 is rotated to guide the wash water to an upper portion of the spin-drying tub 3 so as to have the wash water fall from the upper portion onto the clothes inside the spin-drying tub 3. FIG. 7 shows a sectional view of the actuating unit 50 to illustrate an operation of the actuating unit 50 when the wobbling device 20 is placed in the wobbling position.

When the actuating pin 54 of the inclined rotary shaft 22 is rotated from the position shown by the two-dot chain line of FIG. 7 to another position shown by the solid line in accordance with a counterclockwise rotating action of the inclined rotary shaft 22 to perform a washing mode operation, the pin 54 is brought into contact with the wobbling pin 53. In such a case, the upper part 31*a* of the first sloping surface 31 of the first rotary unit 30 meets the lower part 41*b* of the second sloping surface 41 of the second rotary unit 40 as shown in FIG. 6. In addition, the lower part 31*b* first of the sloping surface 31 of the first rotary unit 30 meets the upper part 41*a* of the second sloping surface 41 of the second rotary unit 40. Therefore, the two sloping surfaces 31 and 41 are positioned almost horizontally, while the upper surfaces of both the second rotary unit 40 and the support unit 80 are inclinedly positioned This creates an inclined position of the washboard 60, which is assembled to the external surface of the support unit 80. When both the inclined rotary shaft 22 and the second rotary unit 40 in the above state are rotated by the torque of the washing shaft 6*b*, the washboard 60 wobbles upward and downward at a predetermined amplitude in response to a rotating speed of the inclined rotary shaft 22. At the same time, as the washboard 60 wobbles, the rotary blade 90 is rotated to guide forced wash water currents into the water current guide 10 of FIGS. 2A and 2B, and allows the forced wash water currents to fall from the upper portion of the spin-drying tub 3 onto the clothes inside the spin-drying tub 3.

An operational effect of the vertical shaft type washing machine of the present invention having the wobbling device 20 will be described herein below.

When the washing machine is turned on after placing the clothes into the spin-drying tub 3, water is primarily fed into the washing tub 2. At the same time, the drive motor 5 is rotated to generate a rotating force, which is transmitted to the wobbling device 20 through the power transmission unit 6, to actuate the wobbling device 20.

That is, while the water is fed into the washing tub 2, both the washing shaft 6*b* and the vertical rotary shaft 21 are rotated, for example, clockwise by the drive motor 5 at a low speed to rotate the spin-drying tub 3 at a low speed, and cause the clothes to be wetted by the water. The inclined rotary shaft 22, coupled to the vertical rotary shaft 21 through the first rotary unit 30, is also rotated along with the two shafts 6*b* and 21. The inclined rotary shaft 22 is thus rotated clockwise at an angle of about 90° from the position shown by the two-dot chain line of FIG. 5, and so the actuating pin 54 of the shaft 22 is brought into contact with the leveling pin 52. In such a case, the upper part 31*a* of the first sloping surface 31 of the first rotary unit 30 meets the upper part 41*a* of the second sloping surface 41 of the second rotary unit 40 as shown in FIG. 4. Therefore, the upper surfaces of both the second rotary unit 40 and the support unit 80 are horizontally positioned, thus creating a horizontal positioning of the washboard 60. That is, the wobbling device 20 of this invention is placed in its leveling position.

When the inclined rotary shaft 22 at such a leveling position is further rotated clockwise, the upper surface of the second rotary unit 40 is rotated along with the inclined rotary shaft 22 while maintaining the horizontal position of its upper surface. Both the support unit 80 and the washboard 60 maintain their horizontal positions without performing any wobbling action. In such a case, the spin-drying tub 3 is rotated at a low speed by the spin-drying shaft 6*a*, thus rotating the clothes laid on the washboard 60 and allowing the clothes to be uniformly wetted by the water fed into the washing tub 2.

When the washing shaft 6*b* in the above state is rotated counterclockwise, with the spin-drying shaft 6*a* stopped, the vertical rotary shaft 21, the first rotary unit 30 and the inclined rotary shaft 22 are simultaneously rotated counterclockwise. Therefore, the actuating pin 54 of the inclined rotary shaft 22 is rotated counterclockwise from the position of FIG. 5 at an angle of about 180°, thus being brought into contact with the leveling pin 52 as shown in FIG. 7

When the actuating unit 50 is shifted from the position of FIG. 5 to the position of FIG. 7, the upper part 31*a* of the first sloping surface 31 of the first rotary unit 30 meets the lower part 41*b* of the second sloping surface 41 of the second rotary unit 40 as shown in FIG. 6. Therefore, the upper surfaces of both the second rotary unit 40 and the support unit 80 are inclinedly positioned, thus creating an inclined position of the washboard 60. That is, the wobbling device 20 of this invention is placed in its wobbling position.

When the inclined rotary shaft 22 at such a wobbling position is further rotated counterclockwise, the second rotary unit 40 is rotated along with the inclined rotary shaft 22. In such a case, both the support unit 80 and the washboard 60 wobble upward and downward without being rotated. When both the support unit 80 and the washboard 60 wobble upward and downward without being rotated as described above, the washboard 60 imparts vertical impact energy to the clothes and generates vertical directional water currents to wash the clothes. In such a case, the impact energy applied to both the clothes and the wash water is increased in proportion to the rotating speed of the washing shaft 6*b*. Therefore, it is possible to accomplish a desired washing effect by appropriately controlling both the amount of wash water and the rotating speed of the washing shaft 6*b* in accordance with the amount of clothes to be washed.

At the same time, as the washboard 60 wobbles, the rotary blade 90 coupled to the washing shaft 6*b* through the tubular boss 70 is rotated in one direction. Due to the rotating action of the rotary blade 90, some of the wash water currents flow into an inlet of the water current guide 10 of FIGS. 2A and 2B, ascend through the water current guide 10 and discharge from an outlet of the water current guide 10 positioned at the upper portion of the spin-drying tub 3. In such a case, the wash water currents discharged from the water current guide 10 pass through the lint trap 11 prior to falling onto the clothes seated in a lower portion of the spin-drying tub 3. Accordingly, impurities are removed from the wash water currents. In addition, the falling of the wash water currents onto the clothes impacts the clothes, and enhances the washing effect. The wobbling device 20 of the present invention is designed so as to be rotated in one direction during a washing mode operation. Therefore, the wash water currents are continuously guided into the water current guide 10. Thus, it is possible to allow a sufficient amount of the water currents to fall from the outlet of the water current guide 10 onto the clothes during the washing mode operation.

When the washing mode operation is completed after a predetermined period of time from a start of the washing operation, the wash water is drained from the washing tub 2 through the drain hose 8 prior to starting a rinsing mode operation which removes detergent from the clothes. After the rinsing mode operation, the spin-drying tub 3 is rotated at a high speed by the spin-drying shaft 6*a* to spin-dry the clothes. In such a case, the actuating pin 54 of the actuating unit 50 is rotated clockwise from the position of FIG. 7 to the position of FIG. 5. The wobbling device 20 is thus converted to its leveling position where the washboard 60 is positioned horizontally. In such a case, the washboard 60 is rotated along with the spin-drying shaft 6*a* without performing any wobbling action, and a desired spin-drying mode operation is performed.

As described above, during a washing mode operation, clothes are washed by the wobbling action of the washboard 60. That is, during the wobbling action of the washboard 60, the clothes are imparted with both mechanical impact energy acting in a vertical direction, and hydraulic impact energy caused by the wash water flowing through the perforations 64 of the washboard 60. Furthermore, the rotary blade 90 is rotated in one direction at the same time as the wobbling action of the washboard 60. Some of the wash water currents flow into the water current guide 10 of FIGS. 2A and 2B, and fall from the outlet of the water current guide 10 onto the clothes. The falling of the wash water currents onto the clothes also imparts impact energy to the clothes, and enhances the washing effect.

As described above, the wobbling device 20 includes the vertical rotary shaft 21, which is arranged between the washing shaft 6*b* and the first rotary unit 30. However, it should be understood that the wobbling device 20 of the present invention may be fabricated without using such a vertical rotary shaft 21. That is, the washing shaft 6*b* may be directly coupled to the first rotary unit 30 in place of being indirectly coupled to the first rotary unit 30 through such a vertical rotary shaft 21, without affecting the functionality of the present invention.

In addition, the leveling pin 52 and the wobbling pin 53 are provided at the upper surface the actuating unit 50, which includes the actuating plate 51 assembled with the upper surface of the second rotary unit 40. However, it should be understood that the position of the two pins 52 and 53 may be changed without affecting the functionality the present of invention. That is, the two pins 52 and 53 may be directly formed at the upper surface of the second rotary unit 40 in place of being formed at the actuating plate 51.

Furthermore, the actuating pin 54 is transversely installed at the upper portion of the inclined rotary shaft 22. However, it should be understood that the position of the actuating pin 54 may be changed. That is, the actuating pin 54 may be provided on any of the first rotary unit 30, the vertical rotary shaft 21 or the washing shaft 6*b*. In such a case, both the leveling pin 52 and the wobbling pin 53 may be placed at appropriate positions of the second rotary unit 40 in accordance with the position of the actuating pin 54.

As described above, the present invention provides a vertical shaft type washing machine having a wobbling device which causes an upward and downward wobbling action of a washboard without rotating the washboard during a washing mode operation. Therefore, the washing machine does not cause clothes to be twisted and tangled up during a washing operation, and prevents abrasion and damage to the clothes. In addition, the washing machine is convenient to use as a user need not untwist and untangle the clothes after the washing operation.

In the washing machine of this invention, a washing shaft is rotated in one direction during a washing operation. Therefore, it is possible to reduce the consumption of electric power of a drive motor. In addition, the expected life span of a drive motor is increased.

In the washing machine of this invention, it is possible to accomplish a desired washing effect with a low water level contained in a washing tub. That is, since the desired washing effect is effectively accomplished by an upward and downward wobbling action of a washboard, clothes laid on the washboard need to be merely wetted by the water during a washing operation. Thus, the washing machine of the present invention requires less water and detergent to carry out a washing operation than the conventional washing machine. Accordingly, the washing machine of the present invention also provides a marketing advantage in light of the recent trend toward saving water and limiting the use of materials that pollute the environment.

In addition, a rotary blade is rotated in one direction at the same time of the wobbling action of the washboard. Due to a rotating action of the rotary blade, wash water is continuously guided into a water current guide, ascends through the water current guide, and falls from an upper portion of a spin-drying tub onto the clothes to enhance the washing effect of the washing machine.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A washing machine comprising:

a washing tub to contain wash water therein;

a spin-drying tub rotatably set in the washing tub to contain clothes therein;

a spin-drying shaft which rotates the spin-drying tub;

a washing shaft which axially passes through and projects from a top end of the spin-drying shaft; and a wobbling device coupled to a projected end of the washing shaft, which causes the clothes to wobble upward and downward to wash the clothes, wherein the wobbling device comprises:

a washboard installed at an interior lower portion of the spin-drying tub, which wobbles upward and downward, and a rotary blade, provided entirely under the washboard and spaced away from the washboard, which rotates in one direction by torque of the washing shaft to guide the wash water to an upper portion of the spin-drying tub.

2. The washing machine according to claim 1, wherein the rotary blade rotates to continuously guide the wash water to fall from the upper portion of the spin-drying tub in response to wobbling of the washboard.

3. The washing machine according to claim 1, wherein the wobbling device causes a wobbling action of the washboard to provide mechanical impact energy to the clothes without concentrically rotating the washboard.

4. A washing machine comprising:

a washing tub to contain wash water therein;

a spin-drying tub rotatably set in the washing tub to contain clothes therein;

a spin-drying shaft which rotates the spin-drying tub;

a washing shaft which axially passes through and projects from a top end of the spin-drying shaft; and a wobbling device coupled to a projected end of the washing shaft, which causes the clothes to wobble upward and downward to wash the clothes, wherein the wobbling device comprises:

a washboard installed at an interior lower portion of the spin-drying tub, which wobbles upward and downward;

a rotary blade provided under the washboard, which rotates in one direction by torque of the washing shaft to guide the wash water to an upper portion of the spin-drying tub;

an inclined rotary shaft arranged in an axial direction of the washing shaft at an angle of inclination;

a first rotary unit which rotates in response to the torque of the washing shaft, having a first sloping surface inclined in a radial direction of the washing shaft at a set angle of inclination;

a second rotary unit arranged to be rotated relative to the first rotary unit, having a second sloping surface which corresponds to the first sloping surface of the first rotary unit, and a hole which is axially formed in the second rotary unit and rotatably receives the inclined rotary shaft therein;

an actuating pin installed to and rotates along with one of the washing shaft, the first rotary unit and the inclined rotary shaft; and a wobbling pin and a leveling pin provided on the second rotary unit at spaced positions, wherein the washboard is arranged outside the second rotary unit, and wobbles upward and downward in response to the actuating pin rotating in contact with the wobbling pin and is leveled in response to the actuating pin rotating in contact with the leveling pin.

5. The washing machine according to claim 4, wherein the wobbling device further comprises:

a vertical rotary shaft which is arranged between the washing shaft and the first rotary unit, and transmits the torque of the washing shaft to the first rotary unit; and a tubular boss which is arranged between the vertical rotary shaft and the washing shaft, and couples the vertical rotary shaft to the washing shaft so as to rotate the vertical rotary shaft by the torque of the washing shaft.

6. The washing machine according to claim 5, wherein the rotary blade is fitted over an external surface of the tubular boss.

7. The washing machine according to claim 6, wherein:

the external surface of the tubular boss has spline ridges formed thereon, the rotary blade includes a central hole having spline grooves formed around an internal surface of the central hole, and the spline ridges engage with the spline grooves to allow the rotary blade to be rotated by torque of the tubular boss, which is rotated in response to rotating of the washing shaft.

8. The washing machine according to claim 7, wherein the rotary blade comprises:

a circular base panel part; and vanes regularly arranged on a lower surface of the panel part which extend in radial directions and generate wash water currents.

9. The washing machine according to claim 8, further comprising an ascending water current guide provided in a sidewall of the spin-drying tub which extends from a lower end to an upper end of the spin-drying tub in a vertical direction, wherein the rotary blade is arranged at a lower end of the ascending water current guide, guides the wash water currents from the vanes to flow upward through the ascending water current guide, and causes the wash water currents to fall from an upper end of the ascending water current guide to a lower portion of the spin-drying tub.

10. The washing machine according to claim 9, further comprising:

a drive motor which generates a driving force;

a power transmission unit which transmits the rotating force from the drive motor to the spin-drying and washing shafts; and a lint trap provided at the upper end of the ascending water current guide, which collects impurities from the wash water currents discharged from the ascending water current guide.

11. The washing machine according to claim 4, wherein the set angle of inclination determines a wobbling angle of the washboard.

12. The washing machine according to claim 4, wherein:

the inclined rotary shaft passes through the hole of the second rotary unit so as to be projected at an upper end thereof from an upper end of the second rotary unit, the actuating pin is transversely mounted to the upper end of the inclined rotary shaft, and the leveling and wobbling pins are arranged on an upper surface of the second rotary unit at positions angularly spaced apart from each other at an angle of about 180°.

13. The washing machine according to claim 12, wherein:

the first inclined surface is formed at an upper end of the first rotary unit, the second inclined surface is formed at a lower end of the second rotary unit, the upper surface of the secondary rotary unit is leveled to have the washboard in a leveled position in response to the actuating pin being rotated in a first direction while coming into contact with the leveling pin, wherein an upper part of the first sloping surface meets an upper part of the second sloping surface, and the upper surface of the secondary rotary unit is inclined to have the washboard in a wobbling position in response to the actuating pin being rotated in a second direction while coming into contact with the wobbling pin, wherein a lower part of the first sloping surface meets the upper part of the second sloping surface.

14. The washing machine according to claim 13, further comprising a support unit which is installed between the second rotary unit and the washboard, wherein:

the support unit is level at an upper surface thereof with the upper surface of the second rotary unit, and includes a bearing which rotatably receives the second rotary unit, and the washboard is supported by the support unit so as to have the washboard wobble regardless of a rotating action of the second rotary unit.

15. The washing machine according to claim 14, wherein the washboard comprises:

a central boss part which is formed at a central portion of the washboard and fitted over the support unit;

a circular blade part which is integrally formed around an outer edge of the central boss part and seats the clothes thereon; and perforations formed at the blade part which allows circulation of the wash water.

16. The washing machine according to claim 15, further comprising a covering plate which is arranged along an edge of the washboard and covers a gap between the spin-drying tub and the edge of the washboard, so as to prevents the clothes from dropping to a position under the washboard.

17. A washing machine comprising:

a washing tub to contain wash water therein;

a spin-drying tub rotatably set in the washing tub to contain clothes therein;

a wobbling device having a washboard for seating the clothes thereon, and a rotary blade provided at a bottom portion of the spin-drying tub and spaced away from the washboard, wherein the rotary blade is positioned entirely underneath the washboard;

a drive motor which provides a rotating force;

a rotating shaft which rotates and transfers the rotating force of the drive motor to the wobbling device, wherein the wobbling device levels the washboard and rotates the spin drying tub in response to rotating of the rotating shaft in one direction, and wobbles the washboard upward and downward to wash the clothes and rotates the rotary blade part to guide the wash water to an upper portion of the spin-drying tub in response to rotating of the rotating shaft in another direction.

18. The washing machine according to claim 17, wherein the rotary blade comprises:

a circular base panel part; and vanes regularly arranged on a lower surface of the panel part which extend in radial directions and generate wash water currents.

19. The washing machine according to claim 17, wherein the washboard is provided with perforations which circulates the wash water to provide hydraulic impact energy to the clothes.

20. The washing machine according to claim 17, wherein the washing machine is a vertical shaft type washing machine.

21. The washing machine according to claim 17, wherein:

the clothes are moved vertically in response to upward and downward wobbling of the washboard, and the washboard wobbles upward and downward in a set angle of inclination.

22. A washing machine comprising:

a washing tub to contain wash water therein;

a spin-drying tub rotatably set in the washing tub to contain clothes therein;

a wobbling device having a washboard for seating the clothes thereon, and a rotary blade provided at a bottom portion of the spin-drying tub and spaced away from the washboard, wherein the rotary blade is positioned entirely underneath the washboard, and wherein the rotary blade includes a circular base panel, and vanes regularly arranged on a lower surface of the circular base panel which extend in radial directions and generate wash currents;

a drive motor which provides a rotating force;

a rotating shaft which rotates and transfers the rotating force of the drive motor to the wobbling device, wherein the wobbling device levels the washboard and rotates the spin drying tub in response to rotating of the rotating shaft in one direction, and wobbles the washboard upward and downward to wash the clothes and rotates the rotary blade part to guide the wash water to an upper portion of the spin-drying tub in response to rotating of the rotating shaft in another direction; and an ascending water current guide provided in a sidewall of the spin-drying tub which extends from a lower end to an upper end of the spin-drying tub in a vertical direction, wherein the rotary blade is arranged at a lower end of the ascending water current guide, guides the wash water currents from the vanes to flow upward through the ascending water current guide, and causes the wash water currents to fall from an upper end of the ascending water current guide to a lower portion of the spin-drying tub.

23. A washing machine comprising:

a washing tub to contain wash water therein;

a spin-drying tub rotatably set in the washing tub to contain clothes therein;

a wobbling device having a washboard for seating the clothes thereon and a rotary blade provided at a bottom portion of the spin-drying tub, wherein the rotary blade includes a circular base panel, and vanes regularly arranged on a lower surface of the circular base panel which extend in radial directions and generate wash currents;

a drive motor which provides a rotating force;

a rotating shaft which rotates and transfers the rotating force of the drive motor to the wobbling device, wherein the wobbling device levels the washboard and rotates the spin drying tub in response to rotating of the rotating shaft in one direction, and wobbles the washboard upward and downward to wash the clothes and rotates the rotary blade part to guide the wash water to an upper portion of the spin-drying tub in response to rotating of the rotating shaft in another direction; and an ascending water current guide provided in a sidewall of the spin-drying tub which extends from a lower end to an upper end of the spin-drying tub in a vertical direction, wherein the rotary blade is arranged at a lower end of the ascending water current guide, guides the wash water currents from the vanes to flow upward through the ascending water current guide, and causes the wash water currents to fall from an upper end of the ascending water current guide to a lower portion of the spin-drying tub, wherein the wobbling device further comprises:

a first rotary unit which rotates in response to torque of the rotating shaft, having a first sloping surface inclined in a radial direction of the rotating shaft at an angle of inclination;

a second rotary unit arranged to be rotated relative to the first rotary unit, having a second sloping surface which corresponds to the first sloping surface and a hole axially formed in the second rotary unit at a set angle of inclination;

an inclined rotary shaft rotatably arranged in the hole and projects from an upper end surface of the second rotary unit;

an actuating pin which is installed to and rotates along with one of the inclined rotary shaft, the rotating shaft and the first rotary unit; and wobbling and leveling pins provided on the second rotary unit at spaced positions corresponding to rotating directions of the actuating pin, wherein the washboard wobbles in response to rotating of the actuating pin in contact with the wobbling pin, and is level in response to rotating of the actuating pin in contact with the leveling pin.

24. The washing machine according to claim 3, wherein:

the first inclined surface is formed at an upper end surface of the first rotary unit, the second inclined surface is formed at a lower end surface of the second rotary unit, the upper end surface of the secondary rotary unit is leveled to have the washboard in a leveled position in response to the actuating pin being rotated in a first direction while coming into contact with the leveling pin, wherein an upper part of the first sloping surface meets a lower part of the second sloping surface, and the upper end surface of the secondary rotary unit is inclined to have the washboard in a wobbling position in response to the actuating pin being rotated in a second direction while coming into contact with the wobbling pin, wherein a lower part of the first sloping surface meets the lower part of the second sloping surface.

25. A washing machine comprising:

a washing tub to contain wash water therein;

a spin-drying tub rotatably set in the washing tub to contain clothes therein;

a wobbling device having a washboard for seating the clothes thereon, and a rotary blade provided at a bottom portion of the spin-drying tub and spaced away from the washboard, wherein the rotary blade is positioned entirely underneath the washboard;

a drive motor which provides a rotating force;

a rotating shaft which rotates and transfers the rotating force of the drive motor to the wobbling device, wherein the wobbling device wobbles the washboard, moves the clothes thereon in a vertical direction and rotates the rotary blade to guide the wash water to an upper portion of the spin-drying tub in response to rotating of the rotating shaft in one direction.

26. The washing machine according to claim 25, wherein the rotary blade comprises:

a circular base panel part; and vanes regularly arranged on a lower surface of the panel part which extend in radial directions and generate wash water currents.

27. A washing machine comprising:

a washing tub to contain wash water therein;

a spin-drying tub rotatably set in the washing tub to contain clothes therein, wherein the spin-drying tub has a cylindrical sidewall;

a spin-drying shaft which rotates the spin-drying tub;

a washing shaft which axially passes through and projects from a top end of the spin-drying shaft; and a wobbling device coupled to a projected end of the washing shaft, which causes the clothes to wobble upward and downward to wash the clothes, wherein the wobbling device comprises:

a washboard installed at an interior lower portion of the spin-drying tub, which wobbles upward and downward, and a rotary blade, provided under the washboard and spaced away from the washboard, wherein the rotary blade rotates in one direction by torque of the washing shaft to guide the wash water to an upper portion of the spin-drying tub, and wherein the rotary blade is not mounted to the cylindrical wail of the spin-drying tub.

* * * * *

UNITED STATES PATENT AND TRADEMARK OFFICE

CERTIFICATE OF CORRECTION

PATENT NO. : 7,171,828 B2
APPLICATION NO. : 10/197332
DATED : February 6, 2007
INVENTOR(S) : Hyung-Kyoon Kim et al.

It is certified that error appears in the above-identified patent and that said Letters Patent is hereby corrected as shown below:

Title Page;
First Page, Column 2 (Other Publications), Line 1, change “Europena” to --European--.

Column 18, Line 38, change “claim 3,” to --claim 23,--.

Column 20, Line 15, change “wail” to --wall--.

Signed and Sealed this

Fifteenth Day of May, 2007

JON W. DUDAS
*Director of the United States Patent and Trademark Office*